United States Patent [19]

Winters, Jr.

[11] Patent Number: 4,781,638

[45] Date of Patent: Nov. 1, 1988

[54] KICKBOARD FOR SWIMMERS

[75] Inventor: Arthur A. Winters, Jr., Orlando, Fla.

[73] Assignee: Winters' Innovations, Inc., Orlando, Fla.

[21] Appl. No.: 876,103

[22] Filed: Jun. 19, 1986

[51] Int. Cl.[4] ..... B63C 9/08

[52] U.S. Cl. ..... 441/129; 434/254; 441/136

[58] Field of Search ..... 441/65–67, 441/74, 55, 56, 129, 136; 272/1 B, 71; 434/254; D71/1; D21/237

[56] References Cited

U.S. PATENT DOCUMENTS

| | | | |
|---|---|---|---|
| 1,023,601 | 4/1912 | Simpson | 441/65 |
| 3,124,815 | 3/1964 | Harvey | 441/55 |
| 3,226,114 | 12/1965 | Swider | 434/254 |
| 3,945,068 | 3/1976 | Carbonero | 441/56 |
| 4,406,628 | 9/1983 | Rademacher | 434/254 |
| 4,518,364 | 5/1985 | Jacobson | 441/129 |

*Primary Examiner*—Sherman D. Basinger
*Assistant Examiner*—Jesus D. Sotelo
*Attorney, Agent, or Firm*—James H. Beusse

[57] ABSTRACT

A variable drag and buoyancy kickboard for a swimmer comprising a first portion, a second portion, and a plurality of pairs of hand grasping locations. The second portion extends from a lateral edge of the first portion. The first portion defines a first planar surface and the second portion defines a second planar surface. The first and second planar surfaces form an obtuse angle. The first and second portions having a periphery upon which the hand grasping locations are disposed. Each pair of hand grasping locations are laterally opposite each other on the periphery. Grasping different pairs of hand grasping locations varies the flow characteristics of the kickboard by varying its position in the water. Thus, the drag of the kickboard may be varied.

13 Claims, 4 Drawing Sheets

KICKBOARD FOR SWIMMERS

FIELD OF THE INVENTION

The present invention is directed to training and a exercise equipment for swimming and, more particularly, to variable resistance kickboard for swimmers.

BACKGROUND OF THE INVENTION

In the past, various kickboards have been available to help swimmers improve their swimming ability. One such kickboard is described in U.S. Pat. No. 3,945,068 to Carbonero. The kickboard described in that patent has an upturned forward end and a downturned rearward end. The forward end of the board is upturned for minimizing any tendency of the board to dive into the water caused by the downturned rearward end. A pair of flexible loops are secured to a top surface of the board. The loops are centrally located on the top surface and adapted for engagement of the hands of a swimmer during use of the board. In use, the swimmer's hands are inserted under the loops with the palms abutting the top surface of the board. The swimmer is then propelled in the water by kicking.

U.S. Pat. No. 4,518,364 to Jacobson discloses a flat kickboard. The kickboard is buoyant to float on water and has a bottom surface in contact with the water. A top surface of the board faces upwardly and away from the water and is adapted to receive a swimming instruction card. The purpose of providing the swimming instruction card is to permit the swimmer to review the individualized swimming instructions prior to a practice session.

When using the kickboard described by Jacobson, the swimmer is generally positioned immediately behind the board. In such a position, it may be difficult to perceive the writing on the swimming instruction card since the viewing angle is quite small. Accordingly, it is desirable to provide a message which is perceptible when viewed from a trailing edge of the kickboard.

One disadvantage of the prior art kickboards is that drag (resistance opposing the motion of the swimmer) of the kickboards cannot be varied. A primary purpose of a kickboard is to provide resistance to a swimmer, in order to strengthen the swimmer's legs while maintaining good body position. However, as the swimmer's ability improves, more resistance is needed so that the kickboard will actually benefit the swimmer in proportion to his ability. If a kickboard is designed for rehabilitating a patient or helping a beginning swimmer, it would not be very helpful in developing the muscles of a competitive swimmer since it does not have variable resistance. Since a competitive swimmer's strength is much greater than that of a beginner, a greater resistance is needed to further develop the competitive swimmer's muscles. However, even the ability and strength between two competitive swimmers may be quite diverse. Accordingly, to maintain maximum effectiveness, it is desirable to vary the drag of a kickboard to accomodate each swimmer's needs, whatever his ability and body type.

Another disadvantage of such prior art kickboards, is that the buoyancy of such kickboards is not variable. A kickboard that is highly buoyant may put the swimmer at an unnatural angle or posture when using the board. A kickboard which is not buoyant enough may provide too much drag for a beginning swimmer to tolerate. Additionally, an individual swimmer may need a different kickboard buoyancy for each different swimming stroke. For example, a buoyant board may be desirable when practicing a butterfly kick whereas a nonbuoyant board may be desirable for the same swimmer when practicing a breaststroke kick.

In a typical practice, a swimmer using a kickboard will kick a preselected distance and then rest a designated time interval. For example, a coach instructing a swim team may require each swimmer to kick 100 yards, rest for 30 seconds, and then kick another 100 yards, etc. Since a typical swim team has swimmers of diverse abilities; i.e., faster and slower swimmers, each swimmer will be kicking at different rates and, consequently, resting at different times. If the coach desires to talk to the swimmers while they are resting, he must talk to each swimmer individually since they are not all resting at the same time. This reduces the effectiveness of the coach as he cannot observe the swimmers who are swimming when he is instructing the swimmers who are resting. Accordingly, it is desirable to provide a kickboard which is capable of handicapping each swimmer such that they will all be kicking and/or resting simultaneously.

SUMMARY OF THE INVENTION

An object of the present invention is the provision of an improved kickboard which overcomes the above discussed disadvantages, as well as others, of the prior art.

Another object of the present invention is the provision of a kickboard in which the drag may be varied.

A further object of the present invention is the provision of a kickboard having a variable buoyancy.

A still further object of the present invention is the provision of a kickboard which is capable of handicapping each swimmer on a swim team such that all swimmers kick at the same rate.

A still further object of the present invention is the provision of a subliminal message on the surface of a kickboard which is perceptible when viewed from a trailing edge of the kickboard.

In general, the present invention is a kickboard comprising a first portion, a second portion, and a plurality of hand grasping locations. The second portion extends from one edge of the first portion. The first portion defines a first planar surface and the second portion defines a second planar surface. The first and second planar surfaces form an obtuse angle. The hand grasping locations are disposed about a periphery of the kickboard. A pair of hand grasping locations are laterally opposite each other on the periphery. Grasping different pairs of hand grasping locations varies the flow characteristics of the kickboard by varying its position in the water. Thus, the drag of the kickboard is varied.

More particularly, the first portion defines a rectangular shape and the second portion defines a semicircular shape. In one form of the invention, the kickboard includes a hollow portion which may be filled with a substance to vary the buoyancy of the board. An aperture and plug are provided to permit insertion of the substance within the hollow portion. Thus, the buoyancy of the board may be varied. Another feature of the invention is a subliminal message on one of the board's surfaces which is perceptible when viewed from a sharp angle.

BRIEF DESCRIPTION OF THE DRAWINGS

The present invention is illustrated by way of example in the Figures of the accompanying drawings in which.

The exemplifications set out herein illustrate the preferred embodiments of the present invention and are not to be construed as limiting either the scope of the invention or the scope of the disclosure thereof in any manner.

DETAILED DESCRIPTION OF THE PREFEERED EMBODIMENTS

Figure 1:
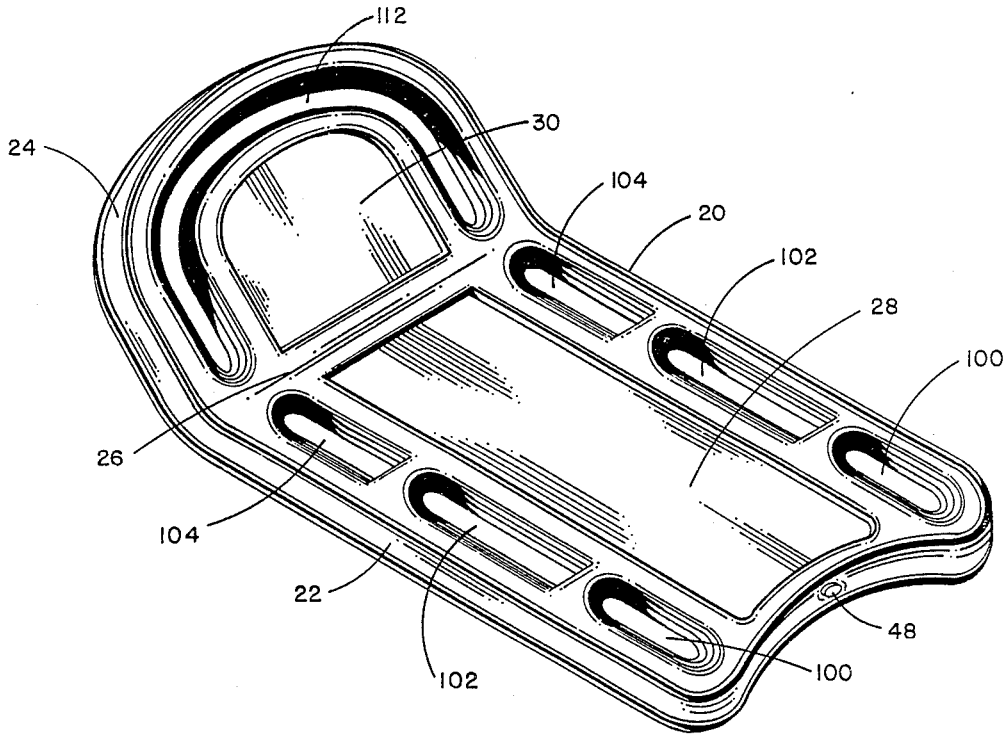
FIG. 1 illustrates a perspective view of a kickboard in accordance with the present invention.
Figure 2:
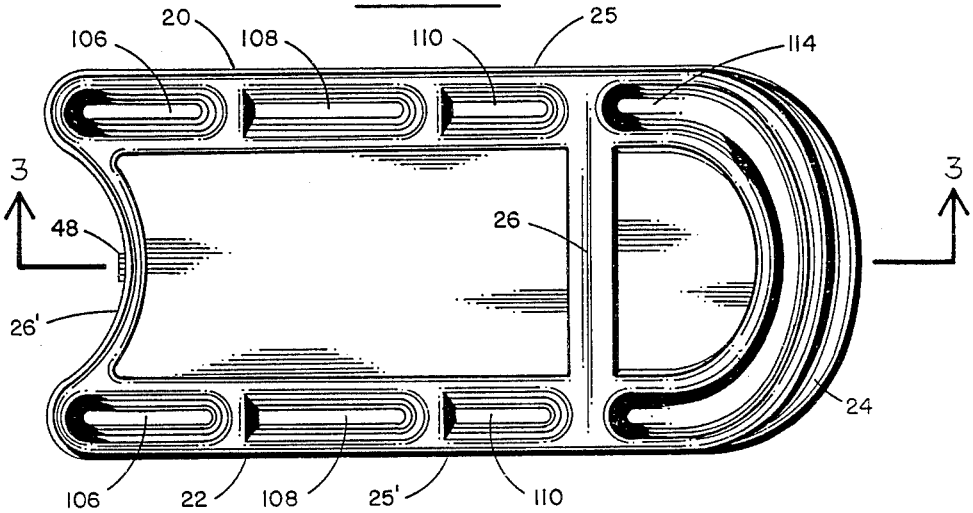
FIG. 2 illustrates a bottom view of the kickboard in FIG. 1.
Figure 3:
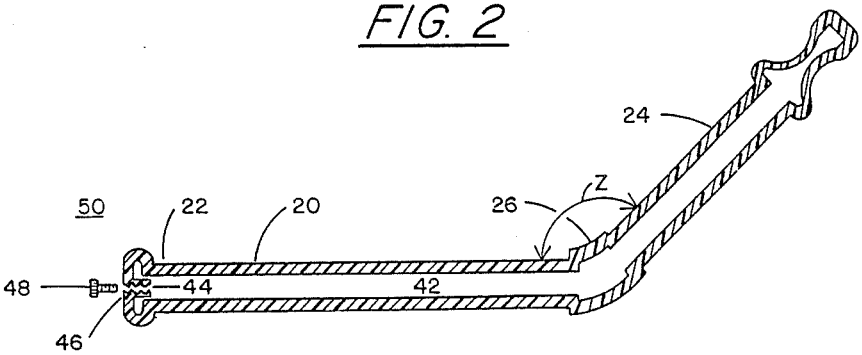
FIG. 3 illustrates a side elevation view, in section, of a kickboard taken along the line 3—3 of FIG. 2.

FIGS. 1 through 3 illustrate a kickboard 20 in accordance with the present invention. In general, the kickboard includes a first portion 22 and a second portion 24. The first portion 22 is substantially rectangular and includes two longitudinal edges 25, 25' and two lateral edge 26, 26'. The second portion 24 has a generally semicircular shape and extends from the lateral edge 26 of the first portion 22. An obtuse angle denoted generally by the letter Z, is formed by a first planar surface 28 of the first portion 22 and a second planar surface 30 of the second portion 24. Although angle Z is shown as being 130°, it is to be understood that other angles are also suitable.

The kickboard 20 includes a plurality of grasping locations 100–110 which are defined by indentations within the surface of the kickboard 20. The second portion 24 also includes indentions 112 and 114 by which the kickboard 20 may be grasped. Each pair of indentions are representative of different drag characteristics to the board 20. As shown in FIGS. 1 and 2 the hand grasping locations 100–110 are disposed about the periphery of the kickboard 20. As will be understood in greater detail below, orienting the kickboard differently in water varies the drag of the kickboard 20 to provide a desired drag to oppose the motion of a swimmer. The plurality of hand grasping locations 100–110 permits variation in the orientation with respect to the water.

Figure 5:
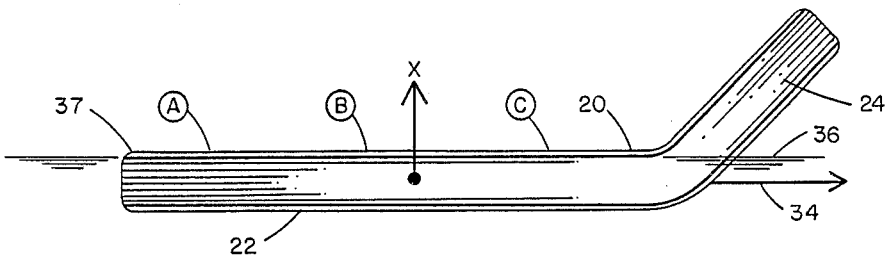
FIG. 5 illustrates a side elevation view of the kickboard in motion with the rectangular portion substantially horizontal and the semicircular portion turned upward and forward.
Figure 4:
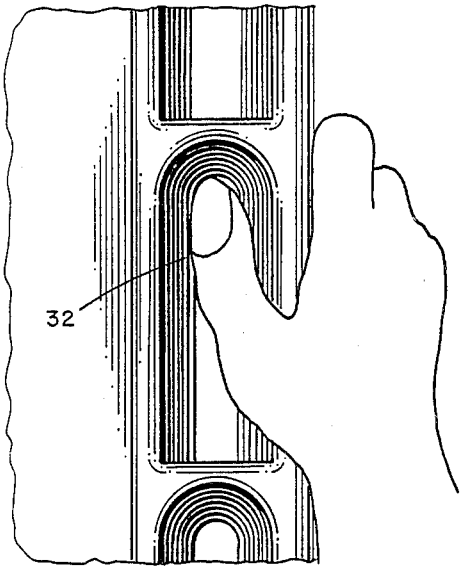
FIG. 4 illustrates a user grasping the kickboard in accordance with the present invention.

Reference is made to FIG. 4 in conjunction with FIG. 5 which illustrates a grasping location 102 being grasped by a user. The user's hand is placed along the periphery of the board 20 with the user's thumb placed within the identation. The indentation provides a comfortable hand position for the user to reduce fatigue.

Figure 6:
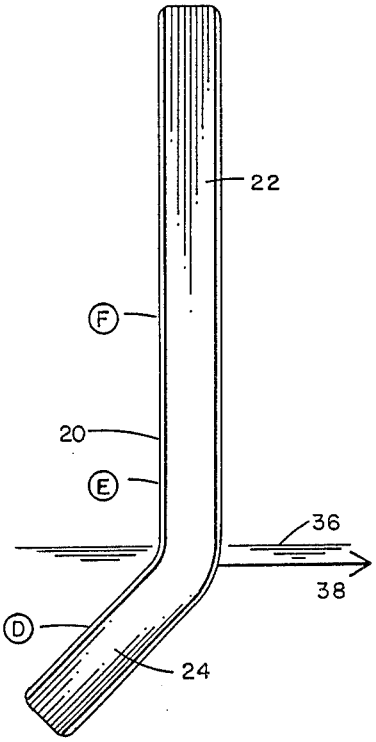
FIG. 6 illustrates a side elevation view of a kickboard in motion with the rectangular portion being substantially vertical and the semicircular portion turned downward and rearward.
Figure 7:
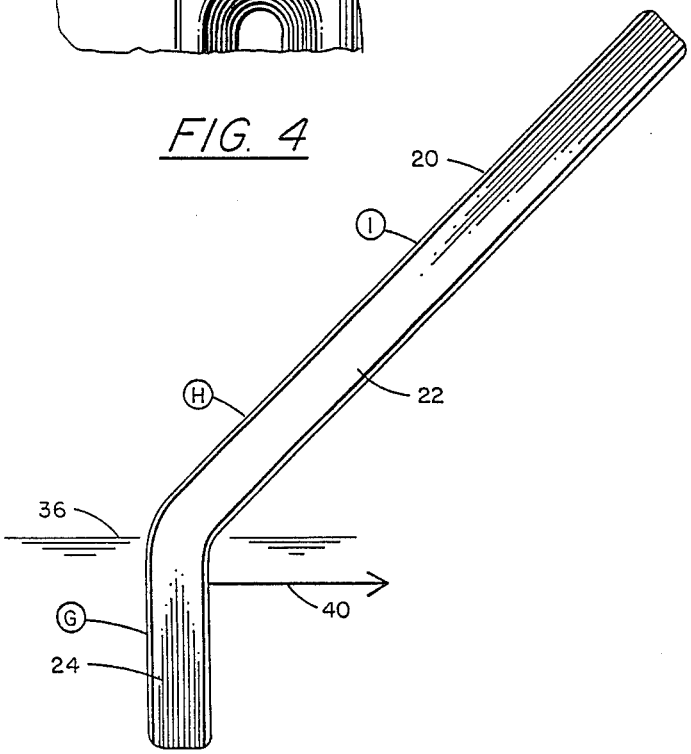
FIG. 7 illustrates a side elevation view of a kickboard in motion with the semicircular portion substantially vertical and the rectangular portion turned upward and forward.

Reference is now made to FIGS. 5, 6 and 7 which illustrate various orientations of the kickboard 20 within water 36 to vary the kickboard's drag. In a preferred manner of use, the swimmer holds the kickboard 20 in front of himself with his body substantially horizontal and his arms substantially parallel with his body. As the swimmer kicks to propel himself, the kickboard's orientation in the water will resist the motion of the swimmer, thus making him work harder to propel himself. Preferably, the swimmer does not rest his body on the kickboard 20. Rather, he holds the board forward of himself with respect to the motion of the board. Since the swimmer does not rest his body on the kickboard 20, he can use the kickboard to develop front kicks (crawl, breaststroke and butterfly) and back kicks (backstroke). To develop back kicks, the swimmer simply holds the board forward of himself while floating on his back. Thus the kickboard 20 can be used to develop all four competitive kicks. i.e., front flutter, back flutter, breaststroke (usually called frog or whip), butterfly (usually called the dolphin). Additionally, it can be used to rest the head and lower arm when teaching the side stroke, over-hand side stroke, regular scissors kick, and inverted scissors kick. Scissor kicks are used extensively in lifesaving techniques, synchronized swimming, and water polo.

In FIG. 5, the kickboard 20 is shown being propelled in a direction indicated by arrow 34. The first portion 22 is substantially horizontal to the surface of the water 36 and the second portion 24 is turned upward and forward with respect to the motion of the board 20. The orientation of the kickboard 20 in the water 36 has the least amount of drag opposing the motion of the swimmer. When the swimmer grasps the board 20 (in the manner illustrated in FIG. 4) in the location designated by the letter A, only a small amount of the kickboard 20 is submerged in the water 36 and the lower surface of the kickboard 20 glides along the surface of the water 36. By holding a kickboard at A, the swimmer naturally exerts a downward force which causes the first end 37 to submerge more than the rest of the board 20. This causes the second portion 24 to extend out of the water since the center of buoyancy, designated by X, is between the downward force and the center of buoyancy X. Consequently, the drag of the kickboard is small. When the kickboard is held in the position designated by the letter B, more of the second portion 24 is submerged since the downward force acting at B is closer to the center of buoyancy. Since more of the second portion is submerged, water must flow around it and the drag is slightly increased. Holding the kickboard in the position designated C submerges the second portion 24 even more to further increase drag. Thus, in the orientation shown in FIG. 5, the drag on the board 20 may be varied by grasping the board 20 in different grasping locations.

FIG. 6 illustrates a second kickboard orientation in which the first portion is substantially vertical, and the second portion 24 extends downwardly and rearwardly with respect to the kickboard's motion, represented by arrow 38. When the swimmer holds the board in position D, the entire second portion 24 is submerged and the second portion 24 acts as a barrier to restrict the flow characteristics in the water. Consequently, the kickboard provides more drag than when held in position C of FIG. 5. Likewise, when held in positions E, F and G, even more of the board 20 is submerged and the drag is increased still further.

FIG. 7 represents a third orientation of the kickboard 20 in the water 36 grasped at location H. The swimmer can hold kickboard 20 in any one of positions H, I, J and K. Holding in position H, the second portion 24 is substantially vertical and the first portion 22 extends upward and forward with respect to the kickboard's motion designated by the numeral 40. Since the second portion 24 is substantially perpendicular to the direction of motion 40, the water 36 does not easily flow around the kickboard 20. Accordingly, the drag on the kickboard 20 is increased. In positions I, J, and K first portion 22 is substantially vertical and second protion 24 extends forward into the water. Thus, more of the kickboard 20 is submerged and the drag is increased. Thus, as illustrated in FIGS. 5 through 7, the drag of the kickboard 20 may be varied by changing its orientation with respect to the water and by varying the location at which the swimmer holds the kickboard 20. It is to be understood, that many other orientations and positions could be utilized with the board 20. However, every orientation and position is not included herein for brevity. As is evident however, the orientation of the board in the water is only a function of how the board is grasped, and the board may be grasped in numerous locations. Therefore, by varying the drag of the kickboard 20, the kickboard can be an effective tool to help the swimmer develop his kicking ability and stamina from the early stages of his development to the advanced stages. Additionally, the kickboard can be used effectively by both novices and advanced swimmers.

Reference is again made to FIG. 3 which illustrates how the buoyancy of the kickboard 20 may be varied. Preferably, the kickboard 20 is made by rotational molding or blowmolding so as to produce a kickboard having a hollow region 42. The kickboard 20 may be formed of a linear polyethylene, cross-linked polyethylene, or any other substantially rigid material. The kickboard 20 further includes a port or aperture 44 and a plug 48 dimensioned for insertion into the aperture 44. Preferably, the plug 48 is threaded to intermesh with internal threads 46. The buoyancy of the kickboard 20 may be varied by removing the plug 48, partially or entirely filling the hollow region 42 with a suitable substance, and then reinserting the plug 48. Although the hollow region is preferably filled with a fluid such as water, it is to be understood that the hollow region could be filled with a solid substance such as sand to vary the buoyancy of the board. Calibrated buoyancy pellets in the form of small metallic pellets, such as BBs, could also be inserted into the hollow region 42 to accurately vary the buoyancy. Additionally, the plug 48 could be replaced by a valve for allowing water into and out of the hollow region 42. Opening the valve permits communication between region 42 and region 50 whereas closing the valve restricts such communication.

By varying the buoyancy of the board, the position of the swimmer in the water may be varied. For example, if the kickboard 20 is extremely buoyant, the swimmer will be much higher in the water than can be maintained in natural swimming. Decreasing the buoyancy places the swimmer in a more natural swimming position. A high buoyancy board may be desirable for a beginning swimmer, handicaped student or for a patient undergoing therapy. Conversely, increasing the density of the board (decreasing the buoyancy) significantly increases the aerobic benefits to the swimmer since he must exert additional effort to keep the board and/or his head above water.

Varying both the drag and the buoyancy of kickboards greatly increases the efficiency of a swimming coach's practice. By varying both the drag and the buoyancy of the kickboards, the coach can precisely handicap his swimmers such that they will all be kicking and/or resting simultaneously. For example, a swimmer with great abilities, would have a kickboard with a low buoyancy oriented in the water to produce a high drag. Conversely, a swimmer with modest abilities may have a kickboard with a higher buoyancy oriented in the water to produce a lower drag. Thus, the faster swimmer and slower swimmer may be precisely handicapped such that they kick a particular distance in substantially the same time. Additionally, by precisely handicapping the swimmers, each swimmer's relative progress and/or effort may be accurately monitored. Thus, if the swimmer having more modest abilities begins to kick the predetermined distance in a shorter time period than the swimmer with great abilities, he is apparently improving at a faster rate. Also, if a swimmer is not putting forth sufficient effort, he will kick the predetermined distance in a longer time period. Additionally, synchronizing the swimmers increases the competitiveness of a workout.

Figure 8:
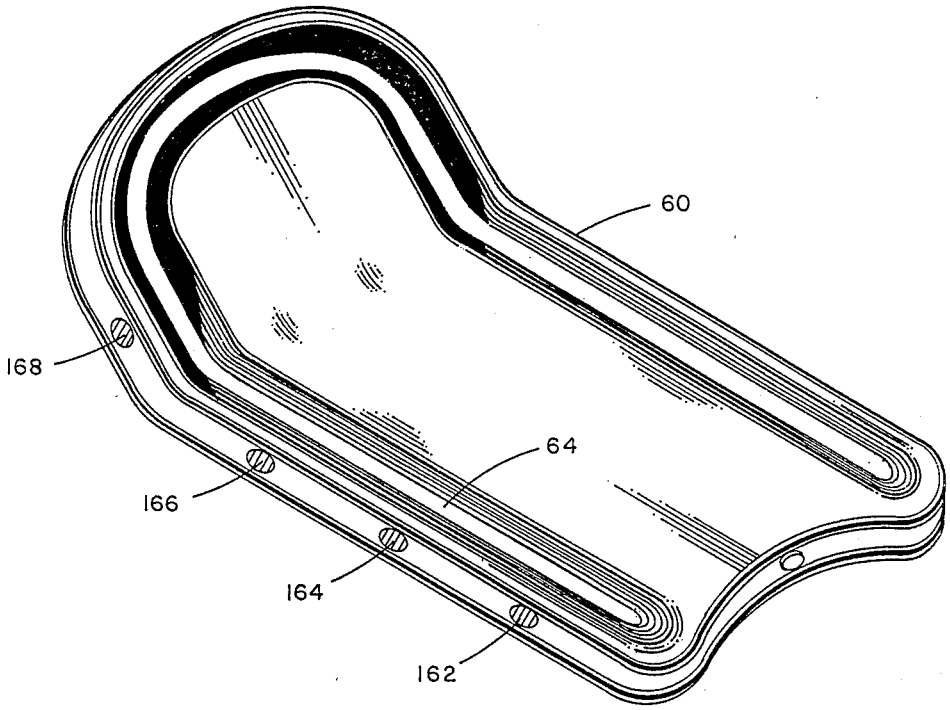
FIG. 8 illustrates another embodiment of a kickboard in accordance with the present invention.

Reference is made to FIG. 8 which illustrates another embodiment of a kickboard 60 having a continuous groove 64 about its periphery. In this embodiment, various hand positions are designated by indicia 162 through 168. Each indicia may be a different colored spot, a number, or other suitable mark to indicate where the swimmer's hands are to be placed. Each indicia is representative of a different drag on the board 60. For instance the indicia may be a braille number for providing a visually impaired swimmer the benefits of using the variable drag kickboard. Additionally, it is to be understood that the kickboard 60 could be formed with a smooth surface rather than having the groove 64.

Figure 9:
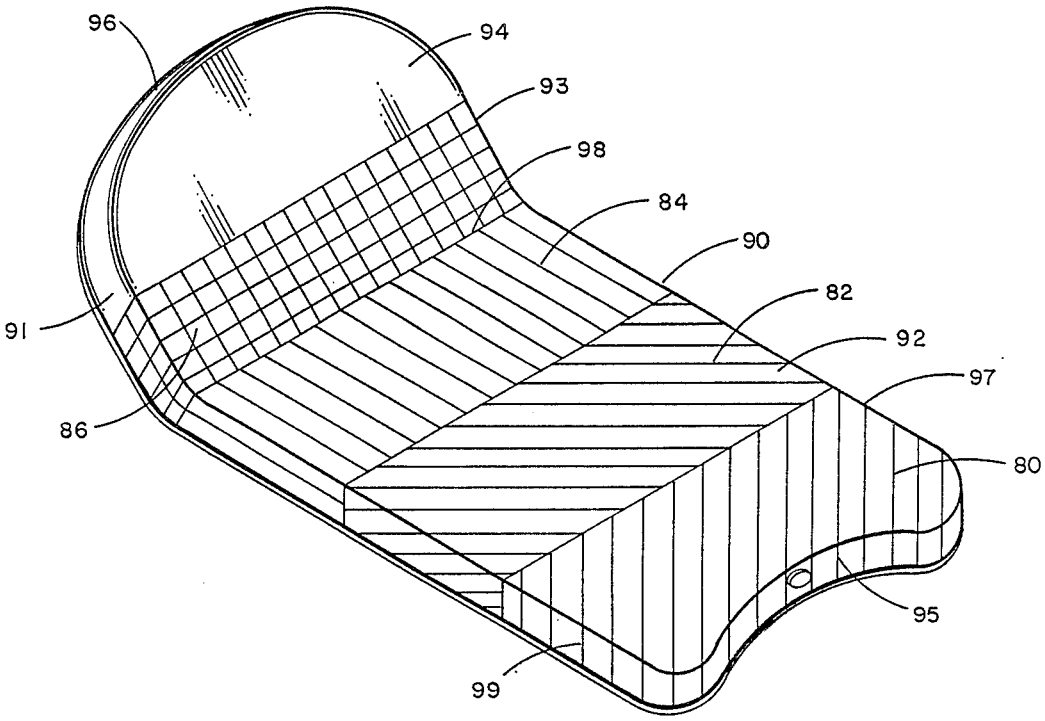
FIG. 9 shows a third embodiment of the kickboard in accordance with the present invention.

FIG. 9 illustrates a kickboard 90 having a first planar portion 92 having a leading edge 98, a trailing edge 95 and substantially parallel outside edges 97 and 99 connecting leading edge 98 and trailing edge 95. A second planar portion having a leading edge 96, a trailing edge 98 and first and second substantially parallel outside edges 91 and 93 forming extensions of the outside edges 97 and 99 of the first portion 92. The trailing edge 98 of the second portion 94 is connected to and extends from the leading edge 98 of the first portion 92 at an obtuse angle. The first and second portions have smooth surface areas 80, 82, 84 and 86 illustrated by different direction lines and cross hatching on FIG. 9, are indicia representative of different drag characteristics of kickboard 90 when grasped by the hands of a swimmer as previously described. For instance, areas 80 through 86 may be different colors to signify the location of holding the board to produce different drag forces. Area 86 extends on the top, bottom and side surfaces of portion 94. Areas 80, 82 and 84 extend on the top, bottom and side surfaces of portion 92.

Figure 10:
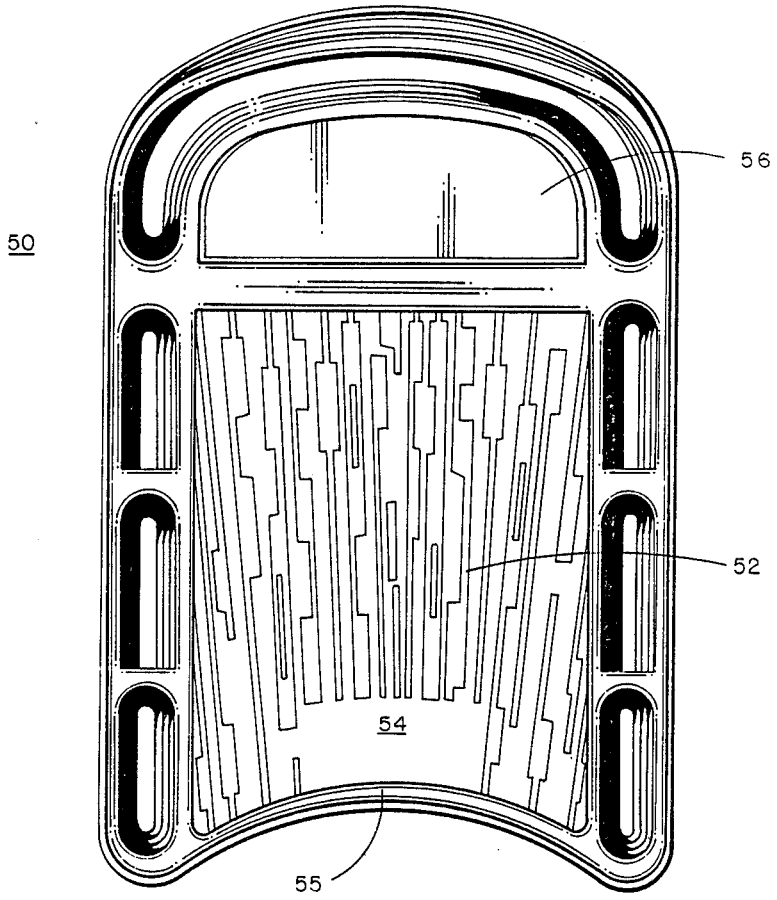
FIG. 10 illustrates a top view of another embodiment of the kickboard which has a subliminal message on its surface.
Figure 11:
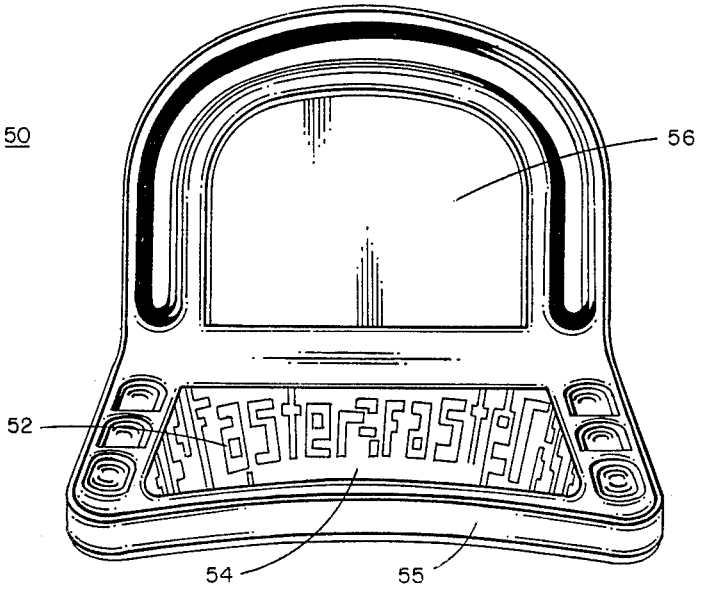
FIG. 11 illustrates a perspective end view of the kickboard of FIG. 10 in which the subliminal message is perceptible.

Reference is now made to FIGS. 10 and 11 which illustrate another embodiment of the present invention in which a kickboard 50 includes a subliminal message 52 on its first surface 54. When viewed from the top, as in FIG. 10, the subliminal message 52 is viewed as a pleasant geometric design. However, when viewed at a sharp angle from a side 55 of the board 50, as shown in FIG. 11, the subliminal message 52 may become apparent. The purpose of the subliminal message is to provide motivation to the user. Since the surface 54 is viewed at an angle during use, the swimmer perceives the message 52 only when using the board. Thus, a subliminal message as depicted in FIGS. 10 and 11 provides a message to the swimmer during use. Although the subliminal message 52 shown spells out "Faster-Faster" it is to be understood that other messages could be utilized. Additionally, it is to be understood that the second portion could be adapted to include a device well known in the art, such as a pacing clock, stopwatch or a heart monitor, to help the swimmer and coach gauge progress.

While the principles of the invention have now been made clear in an illustrative embodiment, it will become obvious to those skilled in the art that many other modifications in structure, arrangement, portions and components may be used in the practice of the invention. Accordingly, it is intended that the description be interpreted as illustrative and not in a limiting sense and that the invention be given a scope commensurate with the appended claims.

What is claimed is:

1. A swimmer's kickboard comprising:

first and second planar portions rigidly secured to one another and forming an obtuse angle; and a plurality of drag indicating indicia disposed on at least one of said first and said second planar portions; and means for grasping the kickboard at locations adjacent said indicia for selectively invoking one of a plurality of different drag characteristics of said kickboard while swimming.

2. A kickboard in accordance with claim 1 wherein a hollow portion is disposed within at least one of said first and said second planar portions, said kickboard further comprising means for permitting a substance to be inserted and constrained within said hollow portion whereby buoyancy of said kickboard may be varied.

3. A kickboard in accordance with claim 2 wherein said permitting means comprises a plug removably secured within an aperture, said aperture disposed through one of said first and said second planar portions and communicating with said hollow portion.

4. A kickboard in accordance with claim 1 wherein each of said indicia is disposed on opposite sides A and B of said first and said second planar portions.

5. A kickboard in accordance with claim 4 wherein each of said grasping locations comprises an indentation within one of said first and said second planar portions.

6. A kickboard in accordance with claim 1 further comprising a subliminal message on a surface of at least one of said first and said second planar portions, said subliminal message being perceptible only when viewed from an end of said kickboard.

7. A kickboard comprising:

a first planar portion having a leading edge, a trailing edge and a first and second substantially parallel outside edges connecting said leading and trailing edges;

a second planar portion having a leading edge, a trailing edge and first and second substantially parallel outside edges connecting said leading and trailing edges, said trailing edge of said second portion being connected to and extending from said leading edge of said first portion at an obtuse angle, said second portion having first and second substantially parallel outside edges forming extensions of said first and second outside edges of said first portion.

a plurality of indicia representative of different drag characteristics of said kickboard disposed upon at least one surface of at least one said planar portions; and a plurality of hand grasping locations defined along said first and second outside edges of said at least one surface adjacent said indicia.

8. A kickboard in accordance with claim 7 wherein said first portion has a generally rectangular shape.

9. A kickboard in accordance with claim 8 wherein said leading edge of said second portion has a generally semicircular shape.

10. A kickboard in accordance with claim 7 wherein said first porion includes a hollow internal region, said kickboard further comprising means for inserting a substance into said internal region whereby bouyancy of said kickboard may be varied.

11. A kickboard in accordance with claim 10 further comprising a subliminal on said at least one surface, said message being perceptible only when viewed from said trailing edge of said first portion.

12. A variable buoyancy kickboard comprising:

a first portion;

a second portion from an edge of said first portion;

said first portion defining a first planar surface and said second portion defining a second planar surface, said first and said second planar surfaces forming an obtuse angle;

means for providing communication between a region external of said kickboard and a hollow internal region within said frst portion, whereby the buoyancy of said kickboard may be varied by inserting of a substance into said internal region; and a plurality of pairs of hand grasping indicia disposed about a peripheral surface of said first and said second portions, each of said pairs of hand grasping indicia being representative of different drag characteristics.

13. A kickboard in accordance with claim 12 wherein each of said pairs of hand grasping indicia is disposed laterally opposite each other.

* * * * *